US006185922B1

(12) United States Patent
Logan

(10) Patent No.: US 6,185,922 B1
(45) Date of Patent: Feb. 13, 2001

(54) AIR ENTANGLEMENT YARN SPLICER

(75) Inventor: Fannie E. Logan, Dalton, GA (US)

(73) Assignee: Williams Specialty Company, Dalton, GA (US)

( * ) Notice: Under 35 U.S.C. 154(b), the term of this patent shall be extended for 0 days.

(21) Appl. No.: 09/236,894

(22) Filed: Jan. 26, 1999

(51) Int. Cl.[7] ..... D01H 3/36
(52) U.S. Cl. ..... 57/22; 57/23
(58) Field of Search ..... 19/144; 28/254, 28/271, 272; 57/1 R, 22, 23, 350

(56) References Cited

U.S. PATENT DOCUMENTS

| | | | | |
|---|---|---|---|---|
| 3,572,025 | * | 3/1971 | Irwin | 57/22 |
| 3,643,417 | * | 2/1972 | Irwin | 57/22 |
| 3,822,538 | * | 7/1974 | Cardell | 57/22 |
| 4,393,646 | * | 7/1983 | Lucchetta | 57/22 |
| 4,432,194 | * | 2/1984 | Luz | 57/22 |
| 4,538,407 | * | 9/1985 | Matsui et al. | 57/22 |
| 4,566,260 | * | 1/1986 | Irmen | 57/22 |
| 4,630,433 | * | 12/1986 | Premi | 57/22 |
| 4,751,813 | * | 6/1988 | Clayton et al. | 57/22 |
| 4,757,676 | * | 7/1988 | Clayton | 57/22 |
| 4,788,814 | * | 12/1988 | Crouch et al. | 57/22 |
| 4,825,630 | * | 5/1989 | Czelusniak, Jr. et al. | 57/22 |
| 4,833,872 | * | 5/1989 | Czelusniak, Jr. et al. | 57/22 |
| 5,182,900 | * | 2/1993 | Horak et al. | 57/22 |
| 5,289,673 | * | 3/1994 | Cottenceau et al. | 57/22 |
| 5,357,740 | * | 10/1994 | Moreland | 57/22 |
| 5,809,761 | * | 9/1998 | Waters | 57/22 |

* cited by examiner

*Primary Examiner*—John J. Calvert
*Assistant Examiner*—Gary L. Welch
(74) *Attorney, Agent, or Firm*—Alan Ruderman; Stephen J. Stark; Miller & Martin LLP

(57) ABSTRACT

A hand-held pneumatic yarn splicing device has a splicing chamber into which a pair of yarn ends to be spliced together may be placed, the chamber having at least one air inlet extending into the chamber for directing air from a high pressure source external of the device into the chamber. The chamber is interchangeable with other chambers and has a pair of projections extending from the wall of the chamber to break up the twist of highly twisted and heat set yarns which are to be spliced together by the action of the high pressure air. The chamber is cylindrical and has a center axial bore and the projections extend radially from the inner wall of the chamber.

15 Claims, 2 Drawing Sheets

AIR ENTANGLEMENT YARN SPLICER

BACKGROUND OF THE INVENTION

This invention relates to a splicer which uses air to intertwine, twist or entangle yarn ends together to form a continuous strand of yarn, and more particularly to a hand-held splicer having a splicing chamber which may accommodate and splice yarns of varying sizes and twists.

In order to join one yarn end to another so that a continuous length of yarn may be fed to various textile machines, such as a tufting machine that uses the yarn to form pile in a backing material in a carpet manufacturing process, the art has developed various yarn splicers. Air entanglement yarn splicers are known in the art wherein a pair of yarn ends are inserted into a chamber into which air under pressure is directed radially or tangentially to separate the end of each yarn into the various fibers and entangle the yarn ends together. All yarn, both those formed from natural fibers and those formed from man-made fibers, are formed from a multiplicity of strands of filament which are arranged in various forms by spinning, cabling or twisting. However, those that are highly twisted heat set yarns are difficult to splice since the yarn strands cannot be broken up or separated into a plurality of fibers, i.e., untangled, readily to permit entangling of the strands by the splicer. In the known prior art pneumatic yarn splicers, air alone has been inadequate to untangle quickly tightly twisted and heat set twisted yarns.

Examples of prior art air twisters are disclosed in Moreland U.S. Pat. No. 5,357,740 which discloses a hand-held splicer of the type under consideration. The Czelusniak, et al., U.S. Pat. Nos. 4,825,630 and 4,833,872 discussed in Moreland and the Crouch, et al., U.S. Pat. No. 4,788,814 also discussed therein, disclose similar splicers. Other splicers of this general type includes Matsui, et al., U.S. Pat. No. 4,538,407, and Irwin U.S. Pat. No. 3,572,025. Other patents disclosing similar splicers are Lucchetta U.S. Pat. No. 4,393,646; Clayton U.S. Pat. No. 4,757,676; Waters U.S. Pat. No. 5,809,761; Irmen U.S. Pat. No. 4,566,260; and Horak, et al., U.S. Pat. No. 5,182,900. Cottenceau, et al., U.S. Pat. No. 5,289,673 discloses an unraveling or untwisting device.

As aforesaid, the prior art twisters have difficulties when twisting tightly twisted and heat set yarns. Since a noninsubstantial amount of yarn is of this type, the desirability of providing a pneumatic yarn twister which splices yarn of this type in addition to the various other yarns in the textile industry is desirable.

SUMMARY OF THE INVENTION

Consequently, it is the primary object of the present invention to provide a pneumatic yarn splicer operating by an entanglement which may readily twist all types of yarn.

It is another object of the present invention to provide a hand-held pneumatic yarn splicer that effectively splices tightly twisted and heat set yarn.

It is a further object of the present invention to provide a hand-held pneumatic yarn splicer having a removable splicing chamber which is interchangeable for use with yarn of different sizes, and includes at least one projection extending into the chamber to break up the twist of highly twisted and heat set yarn as the swirling of induced air rotates the yarn ends against the projection.

Accordingly, the present invention provides a hand-held pneumatic yarn splicing device having a splicing chamber into which a pair of yarn ends to be spliced together may be placed, the chamber having at least one air inlet extending into the chamber for directing air from a high pressure source to break up the yarn fibers and intertwine and twist the fibers together to connect the two yarn ends, the chamber being interchangeable with other chambers and having at least one projection extending into the chamber to break up the twist of highly twisted and heat set yarns so as to permit the yarn fibers to be more readily available for intertwining and twisting, thereby permitting the yarns to be readily spliced together.

The chamber is cylindrical and has a central axial bore and the projection extends from the inner wall of the chamber and break up the twist as the controlled swirling of induced air rotates the yarn ends against the projection. Preferably there may be two projections extending from the wall of the chamber.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
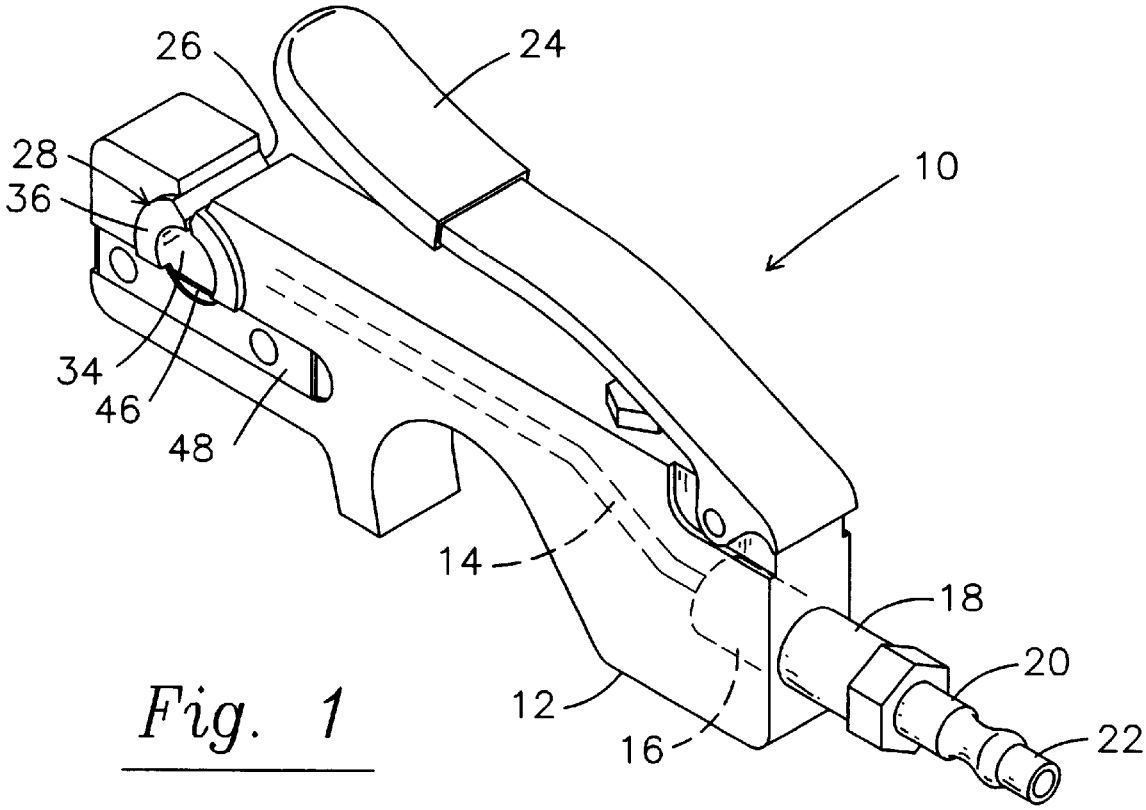
FIG. 1 is a perspective view of a hand held pneumatic yarn splicer incorporating the principles of the present invention.
Figure 2:
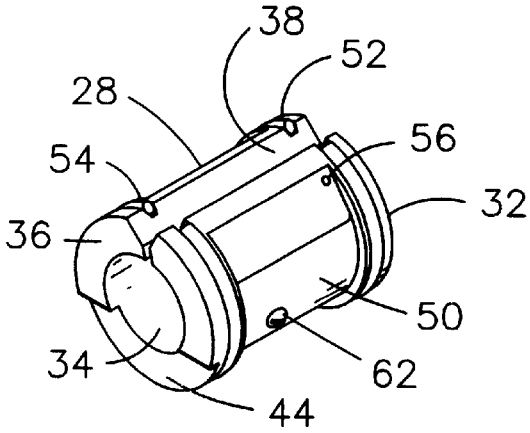
FIG. 2 is a perspective view illustrating a replaceable cylindrical splicing chamber incorporated in the device illustrated in FIG. 1.
Figure 3:
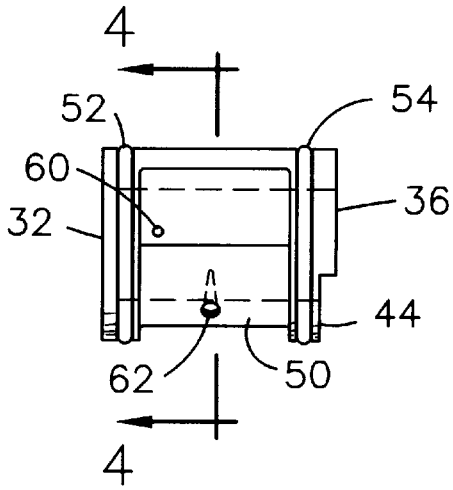
FIG. 3 is a front elevational view of the chamber illustrated in FIG. 2.
Figure 4:
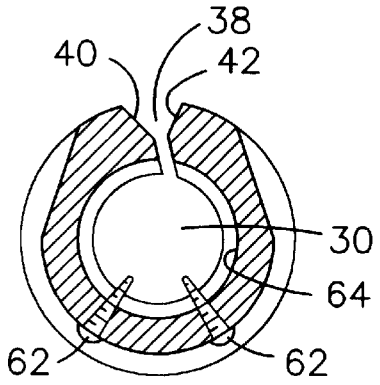
FIG. 4 is a cross-sectional view taken substantially along line 4–4 of FIG. 3.
Figure 5:
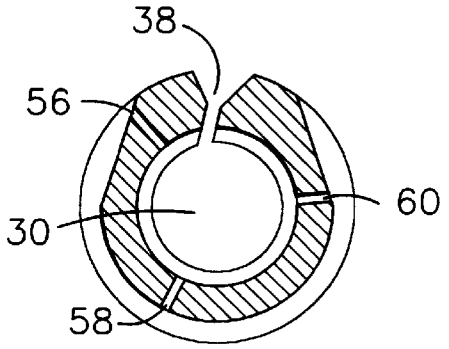
FIG. 5 is a view similar to FIG. 4 taken substantially along line 5–5 of FIG. 9.

Referring to the drawings, a pneumatic yarn splicer 10 is illustrated, the splicer incorporating features comprising the principles of the present invention. As illustrated, the splicer comprises a body 12 of finite width or thickness having a configuration adapted to readily fit within the hand of an operator and having an interior air passageway 14 which may open onto a larger passageway 16 connecting with a nipple or other connector threaded into the passageway 16. A connecting member 18 having a reduced portion 20 is connected in flow communication with a high pressure air line 22 receiving air from an air compressor (not illustrated) within the mill in which the splicer is to be used. A trigger 24 pivotally mounted at the top of the body at the front controls a valve (not illustrated) within one of the passageways 14, 16 so that when the trigger is depressed by squeezing, air may flow from the line 22 through and into the passageway 14.

In the rear portion of the body of the splicer 10 is a transversely extending opening 26 extending from one side of the body to the other and opening at the top of the body. The opening is substantially cylindrical in configuration except where it opens at the top.

Figure 6:
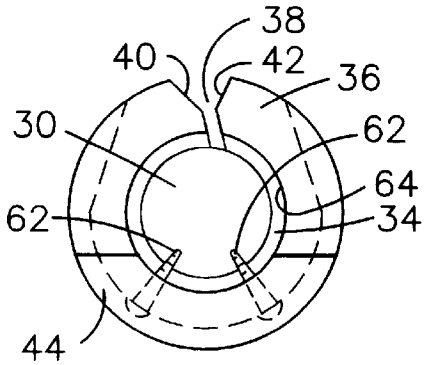
FIG. 6 is one end view of the cylinder illustrated in FIG. 2.
Figure 7:
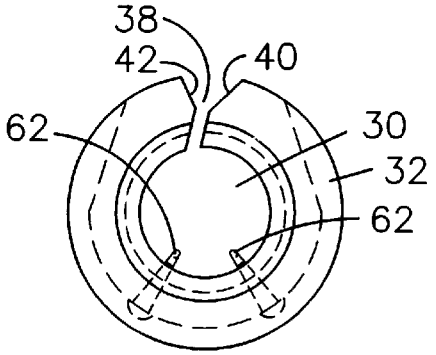
FIG. 7 is the other end view of the cylinder illustrated in FIG. 2.
Figure 8:
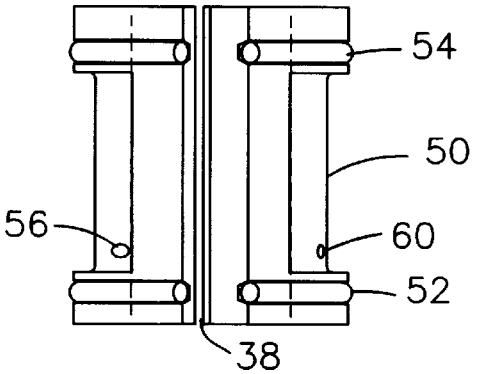
FIG. 8 is a view similar to FIG. 3, but with the cylinder rotated 45°.
Figure 9:
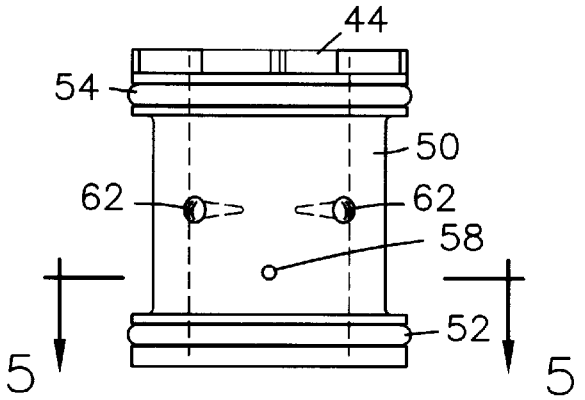
FIG. 9 is a view similar to FIG. 3 with the cylinder rotated approximately 45° in the other direction from FIG. 8.

Removably disposed within the opening 26 is a yarn chamber 28 constructed in accordance with the principles of the present invention, the yarn chamber being a barrel or body of substantially cylindrical form with a first bore 30 extending therethrough from a first end 32 as illustrated in FIG. 7 and opening into a second and larger bore 34 a short distance from the end, the bore 34 continuing to the second end 36 as illustrated in FIG. 6. Opening into both bores 30, 34 is a transversely extending slot 38 extending at the periphery from the first end 32 to the second end 36 and having inclined surfaces 40, 42 extending from the edges of the outer periphery of the yarn chamber and inwardly toward the bores 30, 34 a short distance into the main portion of the slot 38. As will hereinafter be clear, the inclined surfaces act as guides for directing a pair of yarn ends into the slot and thus into the central cavity defined by the larger bore 34.

The second end 36 of the yarn chamber 28 has a recess or slightly undercut step portion 44 at a location below the axis of the bores 30 and 34, and when the chamber 28 is positioned within the body of the splicer, a cutting blade 46 is located within the recess with the cutting edge extending into the plane of the bore 34. A bridging member 48 connected to the body 12 below the axis of the bores 30, 34 acts to clamp the blade in place, the bridging member being recessed slightly intermediate its ends to provide a clearance for the knife edge. A similar bridging member (not illustrated) may be clamped adjacent the first end 30 of the chamber and secured to the body 12 adjacent thereto to fasten the chamber within the body 12. This arrangement also permits reversal of the blade to the opposite end of the body and reversal of the chamber for use by a left handed person.

As illustrated in FIGS. 2 through 9, the chamber 28 has a peripheral recess 50 extending about the central portion axially inwardly from the ends 32, 36 a small distance, the recess 50 extending a small distance from one of the inclined surfaces 40 to a small distance from the other of the inclined surfaces 42. Extending from the surface 40 to the surface 42 adjacent to recess 50 and each end 32, 36 is a respective groove within which a seal 52, 54 is received, the seals each being in the form of a large sector of an "O" ring. Extending from the surface of the recess 50 into the bore 34 is at least one and preferably three small bores 56, 58, 60 best illustrated in FIG. 5, the spacing between adjacent bores being approximately 120° apart at the interior or wall of the bore 34.

It should thus be clear that the air entering the passageway 14 flows around the recess 50 between the seals 52, 54, enters the bores 56, 58, 60 and is directed into the large bore 34 where it swirls about in a turbulent spiral course. As it does this, with a pair of yarn ends in the bore 34, the ends of the yarn will normally break up into strands permitting the yarn to be spliced together as the strands of the first yarn end are intertwined with and twisted together with the strands of the other yarn end. However, in regard to certain yarns such as those which are tightly twisted and heat set, this process is inefficient and generally has been found inadequate.

Accordingly, the present invention provides a means of readily permitting such tightly twisted and heat set yarns to be spliced together using the action of the pressurized air only, apparently by untangling the yarn ends of such yarns prior to the splicing of the ends. To this end the present invention provides at least one, and preferably two, projections 62 which extend from the wall 64 of the bore 34 of chamber 28. Although one such projection aids the splicing process, two projections function very successfully. Additionally, it is not clear whether more than two projections will improve performance. The two projections 62 may be spaced apart by varying amounts, but it has been found that a spacing of approximately 120° to 135° about the wall 64 of the bore 34 is successful. Moreover, the spacial relationship between the projections 62 and the air entrance bores 56, 58, 60 does not appear critical, but in prototype apparatus each projection is spaced intermediate the adjacent pairs of bores and substantially therebetween. The length that the projections extend into the bore 34 appears to be approximately 12% to 20% of the diameter of the bore, and in a chamber having the bore 34 in the order of 0.375 inch (⅜ inch) the projections 62 extend approximately 0.0625 inch (1/16 inch) and thus the projections extend approximately 16.7% of the chamber in diameter. Additionally, the projections may extend radially from, i.e. perpendicular to, the wall of the bore 34 as illustrated, but this does not appear to be critical.

The projections 62 may be small screws threaded through the wall 64 from the peripheral recess 50, the screws having small heads in the recess 50. However, alternatively, the projections may be formed from small steel pins or the like pressed into bores made through the wall 64 from the recess 50, the pins and these bores preferably being tapered.

Use of the yarn splicer is identical to that heretofore described. The splicer is held in one hand with the thumb placed lightly on the trigger 24. The yarns to be spliced are held in the other hand parallel to each other and located into the entry slot 38. The index finger closes off and seals the bore 30 and holds the two yarns, while the other hand holds the yarn against the cutting blade 46 to sever the yarn ends. The trigger 24 is then depressed for a few seconds and after release, the yarns are spliced together.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A yarn splicer for splicing two ends of yarn together comprising: a body having an opening and a passageway for receiving high pressure fluid, a removable barrel located within the opening, said removable barrel being substantially cylindrical and having a yarn chamber having a splicing bore extending therein communicating with said passageway such that when fluid flows through said passageway it enters said bore, said bore being defined by an interior wall of said chamber, said chamber having a slot communicating said bore with the exterior of said body for receipt of said yarn into said bore, and at least one projection extending substantially radially from said wall into said bore.

2. A yarn splicer as recited in claim 1, wherein there are two projections.

3. A yarn splicer as recited in claim 1, wherein said barrel has an outer periphery recessed between ends of said barrel, a plurality of air ways in said interior wall opening onto said recess, and said passageway extending through said body opening at a first end externally of said body and opening at a second end onto said recess.

4. A yarn splicer as recited in claim 3, wherein said slot is formed in and extends through said barrel substantially parallel to the axis of said bore.

5. A yarn splicer as recited in claim 3, wherein said projections extend from the peripheral recess through said wall and into said bore.

6. A yarn splicer as recited in claim 5, wherein there are two projections.

7. A yarn splicer as recited in claim 6, wherein said projections extend a distance into said bore approximately 12% to 20% of the diameter of said bore.

8. A yarn splicer as recited in claim 1, wherein there are two projections.

9. A yarn splicer as recited in claim 8, wherein said barrel has an outer periphery recessed between ends of said barrel, a plurality of air ways in said interior wall opening onto said recess, and said passageway extending through said body opening at a first end externally of said body and opening at a second end onto said recess.

10. A yarn splicer as recited in claim 9, wherein said slot is formed in and extends through said barrel substantially parallel to the axis of said bore.

11. A yarn splicer as recited in claim 10, wherein said projections extend a distance into said bore approximately 12% to 20% of the diameter of said bore.

12. A yarn splicer for splicing two ends of yarn together comprising: a yarn splicing chamber having a longitudinal axis extending between first and second ends of said chamber, means for directing pressurized air into said chamber at an angle inclined relative to said axis, said chamber having a slot substantially parallel to said axis for receipt of a pair of substantially parallel yarns therethrough and into said chamber, said chamber including an interior wall, and at least one projection extending from said wall partly into said chamber in a cantilevered manner and having a free end for effecting a change in air flow pattern of said air in said chamber.

13. A yarn splicer as recited in claim 12, wherein there are two projections.

14. A yarn splicer as recited in claim 12, wherein said means for directing pressurized air into said chamber includes a passageway extending through said wall into said chamber.

15. A yarn splicer as recited in claim 14, wherein there are two projections.

* * * * *